US010689820B1

(12) United States Patent
Smith

(10) Patent No.: US 10,689,820 B1
(45) Date of Patent: Jun. 23, 2020

(54) SURFACE CLEANING MACHINE FOR ROAD CONSTRUCTION

(71) Applicant: Keith E. Smith, Kathleen, FL (US)

(72) Inventor: Keith E. Smith, Kathleen, FL (US)

( * ) Notice: Subject to any disclaimer, the term of this patent is extended or adjusted under 35 U.S.C. 154(b) by 252 days.

(21) Appl. No.: 15/850,586

(22) Filed: Dec. 21, 2017

Related U.S. Application Data

(60) Provisional application No. 62/443,076, filed on Jan. 6, 2017.

(51) Int. Cl.
*E01H 1/04* (2006.01)
*E01H 1/05* (2006.01)

(52) U.S. Cl.
CPC ..... *E01H 1/045* (2013.01); *E01H 1/047* (2013.01); *E01H 1/05* (2013.01)

(58) Field of Classification Search
CPC ..... E01H 1/045; E01H 1/047; E01H 1/05; E01H 1/04
See application file for complete search history.

(56) References Cited

U.S. PATENT DOCUMENTS

| | | | | |
|---|---|---|---|---|
| 4,037,284 | A | 7/1977 | McDonald | |
| 4,236,756 | A | 12/1980 | Hildebrand et al. | |
| 4,701,969 | A | 10/1987 | Berfield et al. | |
| 4,926,517 | A | 5/1990 | Smith | |
| 6,154,911 | A | 12/2000 | Vanderlinden | |
| 6,687,939 | B1 | 2/2004 | Koester | |
| 7,428,767 | B2 | 9/2008 | Lougheed | |
| 8,096,608 | B2 * | 1/2012 | Andou | B62D 33/067 180/89.14 |
| 9,243,376 | B2 * | 1/2016 | Guggino | E01H 5/066 |
| 2016/0090704 | A1 * | 3/2016 | Smith | E01H 1/056 15/82 |

* cited by examiner

*Primary Examiner* — Shay Karls
(74) *Attorney, Agent, or Firm* — William M. Hobby, III

(57) ABSTRACT

This invention relates to multi-purpose self propelled surface cleaning machine for road construction and especially to a drivable surface sweeper and scrapper for the removal of overburden and waste materials during road construction. The prime mover has multiple flexible components and does not need to add make-shift components at a later time.

8 Claims, 6 Drawing Sheets

SURFACE CLEANING MACHINE FOR ROAD CONSTRUCTION

This application claims the benefit of U.S. Provisional Application No. 62/443,076, filed Jan. 6, 2017.

FIELD OF THE INVENTION

This invention relates to a multi-purpose self propelled surface cleaning machine for road construction and especially to a drivable surface sweeper and scrapper for the removal of overburden and waste materials during road construction.

BACKGROUND OF THE INVENTION

During road and large surface construction a variety of equipment is utilized including machines to clean the surface of waste materials or overburden. Cleaning of these surfaces requires the moving or removal of larger waste that street sweepers cannot move but also requires industrial sweepers to clean smaller waste that are not removed with scraping equipment.

Industrial sweepers used in cleaning streets and the like have a rotating brush mounted to the front or rear of a motorized vehicle. An electric or hydraulic motor drives the rotating brush or brushes along the surface of the area being cleaned, sweeping material into a bucket. The brush is controlled from the vehicle's cab with hydraulic or electric controls. The brush of the sweeper needs to be mounted in a position to sweep the area being traversed for cleaning the surface. The present invention uses a drivable self-propelled industrial sweeper and scrapper as part of a machine for the removal of road construction overburden and waste materials during construction of a road.

Prior art street sweepers include U.S. Pat. No. 7,428,767 to Lougheed for a sweeper which has a floating brush or drum assembly. The sweeper has a rotating brush or drum supported by a float arm movably coupled to the sweeper bucket. The float arm is coupled to a linkage to movably support the float arm between a retracted position and a forward position. The float arm is rotationally coupled to the linkage to compensate for height variations and provide a mechanism to rotate the linkage to move the float arm forward relative to the debris collection bucket.

Other prior U.S. patents for street sweepers may be seen in the Hildebrand et al. U.S. Pat. No. 4,236,756 for a Street Sweeper having an Elevating Hopper with Supporting Outriggers and in the Koester U.S. Pat. No. 6,687,939 for a Bucket Sweeper. The McDonald U.S. Pat. No. 4,037,284 is for a Sweeper Assembly while the Vanderlinden U.S. Pat. No. 6,154,911 is for a Debris Lifting Apparatus for use in a Surface Sweeping Vehicle. The Berfield et al. U.S. Pat. No. 4,701,969 is for a Rotary Brush Sweeper with Easily Separable Debris Pan.

The present invention is for a self propelled drivable industrial road cleanup machine which includes a flexible road sweeper and a scrapper for removing overburden and waste during road construction.

SUMMARY OF THE INVENTION

A surface cleaning machine for cleaning road construction waste during the construction of a road or highway or the like has a motorized wheeled vehicle having a plurality of wheels and a vehicle frame having a cab for a driver of the vehicle attached thereto. A sweeper brush frame supports a sweeper brush mounted to one end of the vehicle and has a frame having a hydraulic brush motor thereon for rotating the sweeper brush on said frame. The sweeper brush frame has a linkage to movably support the sweeper brush frame to the vehicle frame and has at least one hydraulic cylinder attached between the sweeper brush frame and the vehicle frame for raising and lowering the sweeper brush responsive to actuation of the lift cylinder. A scrapper blade assembly is mounted to the other end of the vehicle and has a blade box holding a scrapper blade. The scrapper blade assembly has a linkage to movably support the scrapper blade assembly blade box and scrapper blade to the vehicle frame and has at least one hydraulic cylinder attached between the scrapper blade assembly blade box and the vehicle frame for raising and lowering the scrapper blade assembly blade box and scrapper blade responsive to actuation of the lift cylinder. The present road construction surface cleaning machine can scape and sweep a road surface while moving in either forward or reverse direction.

BRIEF DESCRIPTION OF THE DRAWINGS

The accompanying drawings, which are included to provide further understanding of the invention, are incorporated in and constitute a part of the specification and illustrate an embodiment of the invention and together with the description serve to explain the principles of the invention.

DETAILED DESCRIPTION OF EXEMPLARY EMBODIMENT

Figure 1:
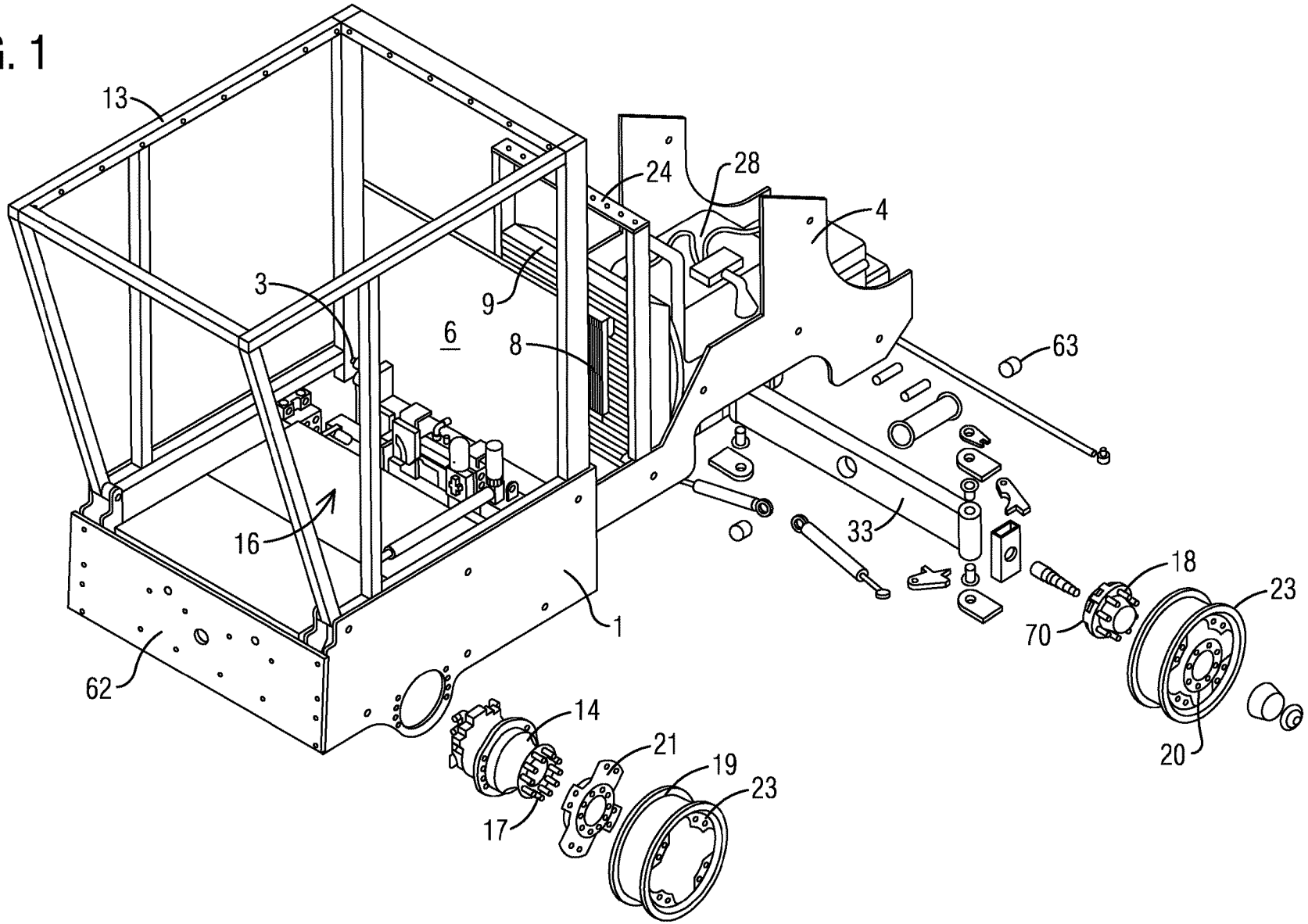
FIG. 1 is an exploded perspective view of the sweeper frame.

This invention is for a drivable sweeper commonly used in road construction to remove overburden. There is a need for a prime mover that addresses many problems with current sweeper machines on the market today. The present prime mover is designed to address the problem at the beginning of the design without adding make-shift components to it later. In the drawings, the components are numbered as follows:

COMPONENTS

1. FRAME
2. CAB TILT CYLINDER
3. CAB LOCKING PIN ACTUATOR
4. REAR HEAVY SIDE PLATES
5. REAR HEAVY LOUVER SHROUD
6. FIRE WALL
7. ROOF
8. OIL COOLER
9. RADIATOR
10. CAB FRESH AIR FILTER
11. ENGINE FILTER
12. CAB
13. BOLT HOLES FOR DETACHABLE ROOF
14. WHEEL MOTORS
15. WATER TANK COMPARTMENT

16. WATER TANK
17. RIM MOUNT BOLT HOLE PATTERN PLATE
18. STEERING AXLE HUB RIM MOUNT
19. RIM
20. STEERING AXLE BOLT HOLE PLATE
21. MOUNTING TABS (HUBS)
22. TIRE
23. TAP RING (RIM)
24. ENGINE COVER SUPPORT ARCH
25. WATER TANK FILL CAP
26. NOTCHED HOLES FOR WATER DRAINAGE
27. BUILT IN DRIP EDGE
28. ENGINE
29. RADIATOR CLEAN OUT COMPARTMENT
30. CAB TILT CONTROLS
31. REAR BLADE ASSEMBLY
32. REAR LIFTING CYLINDERS
33. STEERING AXLE
34. SIDE PLATE
35. BOX BLADE PIVOT POINT
36. BOX BLADE MAIN SCRAPING EDGE
37. BOX BLADE SKID SHOES
38. BOX BLADE RUBBER BOOT
39. BOX BLADE PIVOT HOUSING
40. BOX BLADE DRAG LINKS
41. BRUSH
42. PARALLEL HOUSING
43. PARALLEL RODS
44. PARALLEL SLIDE HOUSING
45. PARALLEL TUBE HOUSING
46. SLIDE TUBES
47. MOUNT PLATE
48. BRUSH LIFT ASSEMBLY
49. HYDRAULIC SIDE SHIFT CYLINDER
50. SLIDE BUSHING
51. SLIDE SEAL
52. REAR YOKE
53. PARALLEL LIFT PLATES
54. FRONT YOKE
55. PIVOT PIN
56. BRUSH FRAME
57. BRUSH MOTOR
58. ENGINE COMPARTMENT
59. HYDRAULIC OIL RESERVOIR
60. DIESEL FUEL RESERVOIR
61. SIDE SHIFT CYLINDER MOUNT
62. UNIVERSAL FRONT MOUNT PLATE
63. STEERING AXLE MAIN PIVOT BUSHING
64. BATTERY COVER
65. A/C UNIT
66. FUEL SENDING UNIT
67. PIVOT CYLINDER
68. IDLE SHAFT
69. RADIATOR CLEAN OUT HATCH DOOR
70. HUB

Figure 2:
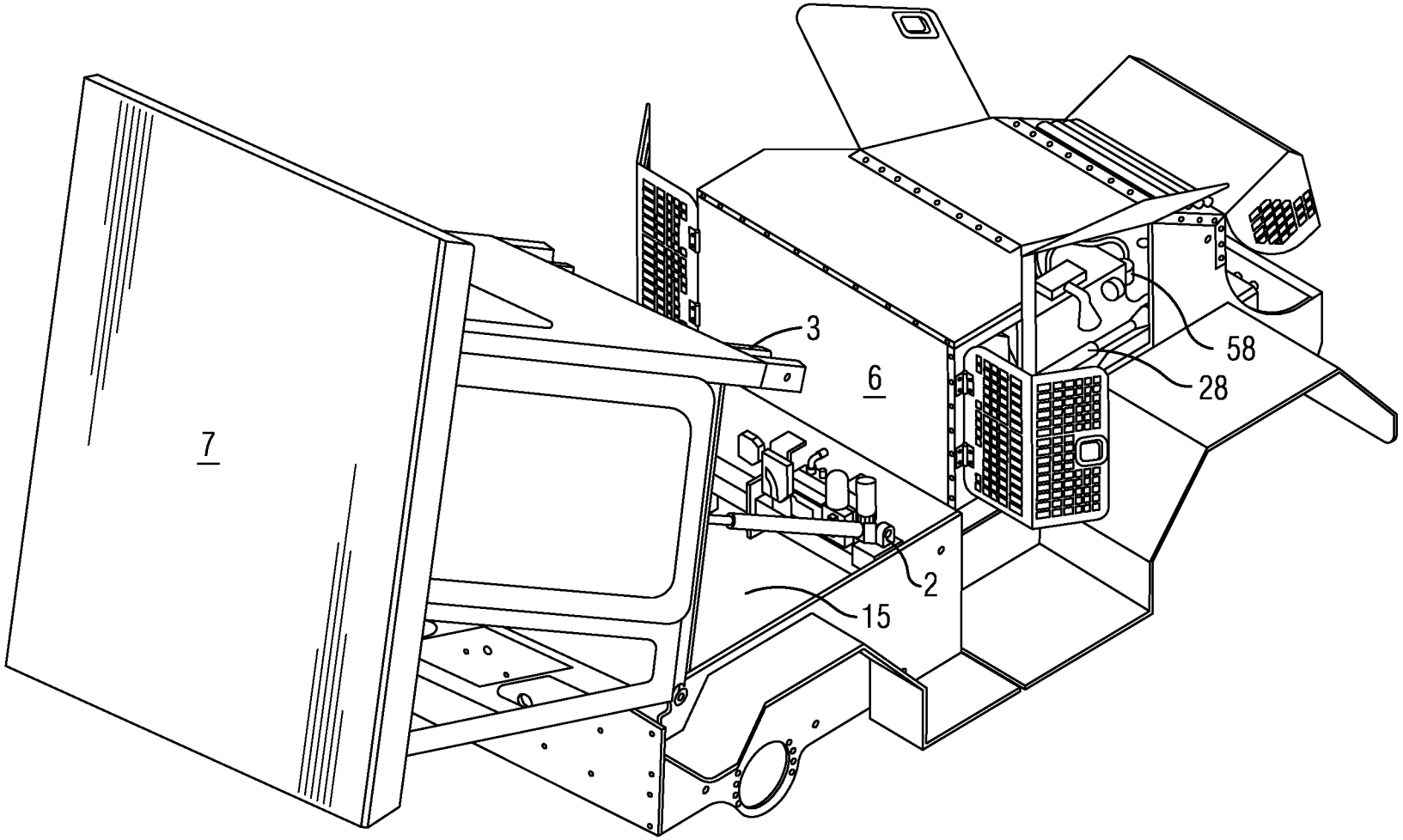
FIG. 2 is a partial perspective view of the sweeper frame of the sweeper having the cab tilted forward.
Figure 3:
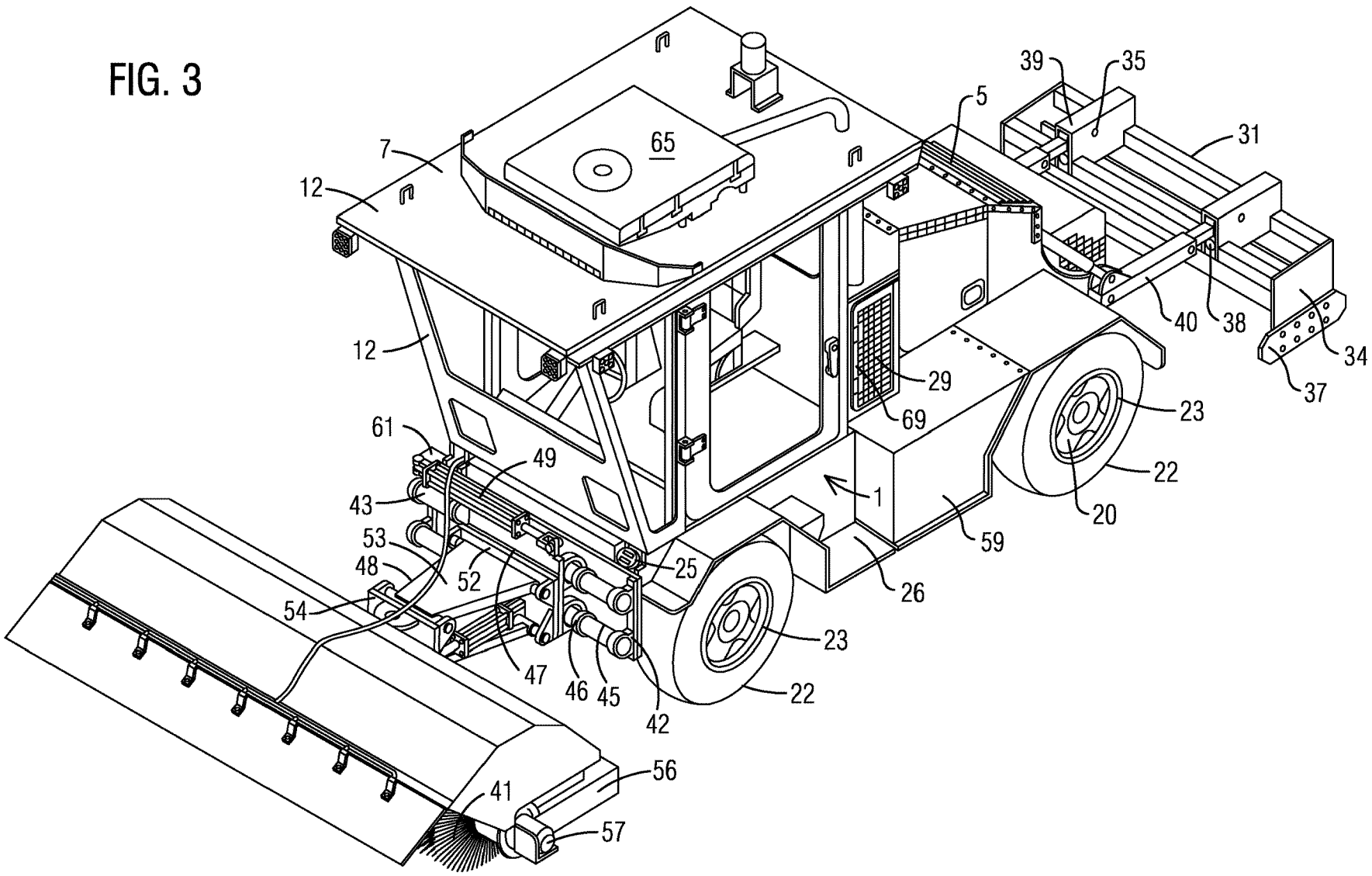
FIG. 3 is a front perspective view of a sweeper in accordance with the present invention.
Figure 4:
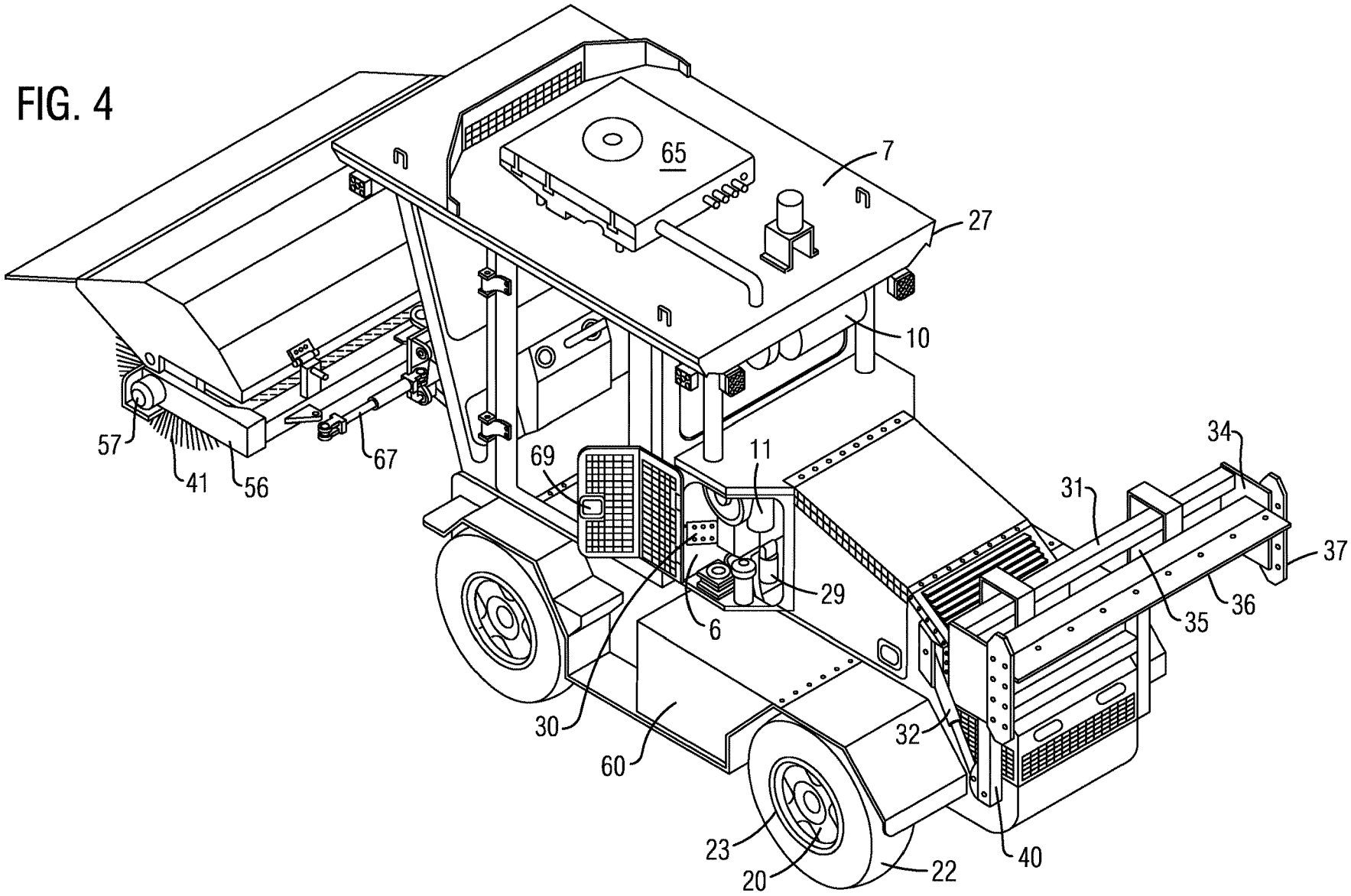
FIG. 4 is a rear perspective view of the sweeper.

Referring to the drawings, FIGS. 1 through 6, a frame 1 (FIG. 1) allows for a water tank compartment 15 (FIG. 2). The engine faces the fan 28 (FIG. 1) and provides for increased visibility out the rear of the machine. The rear heavy side plates 4 (FIG. 1) of the frame 1 (FIG. 1) allows the rear blade assembly 31 (FIG. 4) to be mounted thereto. The rear heavy side plates 4 (FIG. 1) of the frame 1 (FIG. 1) allows the rear lifting cylinders 32 (FIG. 4) to be mounted for lifting the rear blade assembly 31 (FIG. 4). A firewall 6 (FIGS. 1 & 4) has a bearer between the cab 12 (FIG. 3) and the engine compartment 58 (FIG. 4). The uniqueness of the firewall 6 (FIGS. 1 & 4) along with the engine fan forward is to create a radiator clean out compartment 29 (FIGS. 3 & 4) to allow the air the engine fan draws in to be pulled from the side of the machine to pass through an oil cooler 8 (FIG. 1) and then flow through the radiator 9 (FIG. 1). Access to the radiator 9 (FIG. 1) and oil cooler 8 (FIG. 1) is provided so that routine maintenance can be performed without any obstructions. The radiator clean out compartment 29 (FIGS. 3 & 4) provides the means to mount the engine air filter 11 (FIG. 4).

The frame 1 (FIG. 1) provides the means for the cab 12 (FIG. 3) to be a separate component which aides in its assembly and removal or replacement. The cab 12 (FIG. 3) is designed to accommodate a cab fresh air filter 10 (FIG. 4). The use of wheel motors 14 (FIG. 1) allows for the uninterrupted space between the two wheel motors which space provides for a water tank compartment 15 (FIG. 2) to house the water tank 16 (FIG. 1) that is in a secure protected unseen location. The wheel motors 14 (FIG. 1) commonly have a rim mount bolt hole pattern 17 (FIG. 1) that would be different from the steering axle hub rim mount 18 (FIG. 1). A variable bolt pattern hub allows a rim 19 (FIG. 1) to be used in any location that may be desired. The hub 70 (FIG. 1) and the rim 19 (FIG. 1) have mounting tabs 21 (FIG. 1) which allows the mounting of the rim 19 (FIG. 1) and provides for a means to dismount the rim 19 (FIG. 1) and flip the tire 22 (FIG. 5) which is needed because the side walls of the tire 22 (FIG. 5) come into frequent contact with curbs or road shoulders. The steering axle bolt hole plate 20 (FIG. 1) provides the means to locate the mounting tabs 21 (FIG. 1) so that the track width of the tires on the front and the tires on the back are in line. The mounting tabs 21 (FIG. 1) attached on the rim 19 (FIG. 1) allow for the rim 19 (FIG. 1) to be flipped to maintain the same wheel track.

A sweeper is commonly used in close quarters with other machinery and around workers so that it is essential to have good visibility out the front and back of the machine. The design of the present frame 1 (FIG. 1) has the engine 28 (FIGS. 1 & 2) positioned with the radiator 9 (FIG. 1) towards the middle of the machine rather than in the rear or side rear-like existing machines on the market. This configuration allows for a more sloped rear portion allowing for an increase in visibility. The location of the radiator 9 (FIG. 1) is essential to create the clean out compartment 29 (FIGS. 3 & 4). The radiator clean out compartment 29 (FIGS. 3 & 4) is located in the middle of the machine to allow for greater visibility out the rear of the machine. The radiator clean out compartment 29 (FIGS. 3 & 4) allows the oil cooler 8 (FIG. 1) to be located in the radiator clean out compartment 29 (FIGS. 3 & 4). The radiator clean out compartment 29 (FIGS. 3 & 4) allows the mounting of the engine's primary engine filter #11 (FIG. 4). The radiator clean out hatch door 69 (FIGS. 3 & 4 & 6) allows maintenance access from either side of the machine while allowing engine air flow. Maintenance can be performed to clean the radiator without obstructions, such as grills, engine cover or AC components. The rear blade assembly 31 (FIG. 4) is kept in a vertical position when it is not being used to keep it out of harm's way since the blade assembly 31 (FIG. 4) is in a horizontal position and with the rear mounted steering axle 33 (FIG. 1), can cause the blade assembly 31 (FIG. 4) to swing outside the track of the vehicle when turning. The blade assembly 31 (FIG. 4) would be specifically designed to scrape hard surfaces such as the surface of a road. During the scraping process obstacles, such as road shoulders, curbs, manhole lids, and the like, may come in contact with the blade. The blade assembly 31 (FIG. 4) has the ability to change its angle and to lift itself over such obstacles as necessary. This is achieved by a box blade side plate 34 (FIG. 4) that has a box blade pivot point 35 (FIG. 4) directly above the box blade main scraping edge 36 (FIG. 4). The box blade main scraping edge 36 (FIG. 4) is located in the center of the box blade side plate 34 (FIG. 4). The sides of the box blade side plate 34 (FIG. 4) has the box blade skid shoes 37 (FIG. 4) extending forward and rearward of the box blade main scraping edge 36 (FIG. 4). The box blade skid shoes 37 (FIG. 4) act as a lifting arm. The box blade rubber boot 38 (FIG. 3) is located in a box blade pivot housing 39 (FIG. 3) to keep the box blade side plate 34 (FIG. 4) and to keep the box blade drag links 40 (FIG. 4) in line. When the box blade main scraping edge 36 (FIG. 4) contacts an object with forward or reverse movement of the machine, the machine pulls the box blade side plate 34 (FIG. 4) by the box blade drag links 40 (FIG. 4) as the machine moves and the box blade main scraping edge 36 (FIG. 4) stops. This causes the box blade side plate 34 (FIG. 4) to rotate slightly to change the vertical position of the box blade main scraping edge 36 (FIG. 4) to the object. When the box blade side plate 34 (FIG. 4) changes its vertical position, it forces the box blade skid shoes 37 (FIG. 4) to lift the box blade scraping edge 36 (FIG. 4) over the obstacle. During the sweeping process it is necessary to extend the edge of the brush 41 (FIG. 5) to one side or the other, which side shifting is accomplished by the use of two parallel round housings 42 (FIG. 3) that holds two parallel rods 43 (FIG. 3) in an exact alignment. A parallel slide housing 44 (FIG. 5) can slide side-to-side on the parallel rods 43 (FIG. 3) of the parallel slide housing 44 (FIG. 5).

Figure 5:
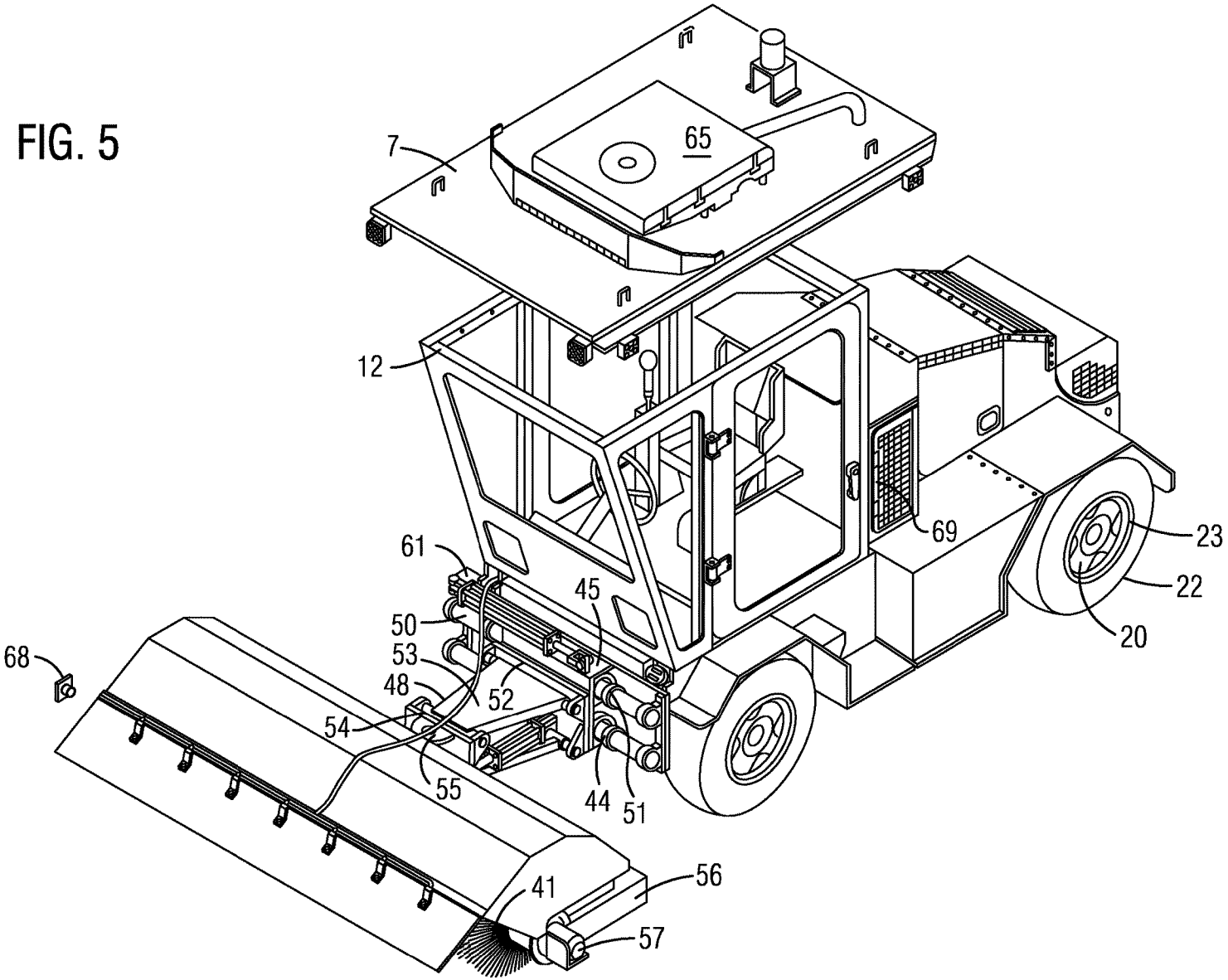
FIG. 5 is an exploded perspective view of a portion of the sweeper of FIGS. 1-4.
Figure 6:
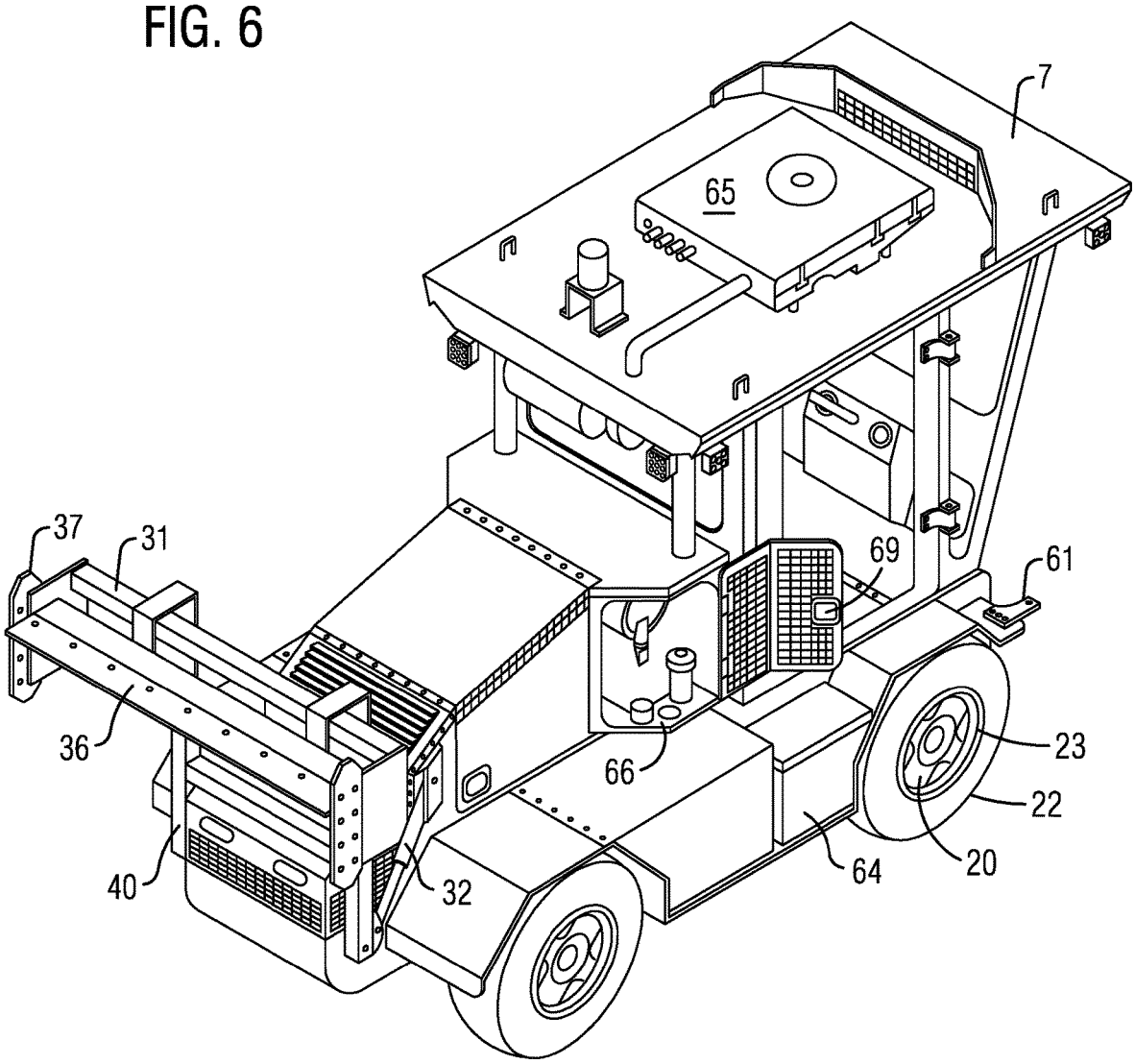
FIG. 6 is rear perspective view of the sweeper.

FIG. 5 has two parallel tube housings 45 (FIG. 5) that hold the slide tubes 46 (FIG. 3) in an exact arrangement to the parallel rods 43 (FIG. 3). The parallel rods 43 are shown as circular in cross-section but can be square or rectangular in cross-section slides in matching slide tubes. The parallel tube housings 45 (FIG. 5) are attached to a mounting plate 47 (FIG. 3) to receive a brush lift assembly 48 (FIG. 3). A hydraulic side shift cylinder 49 (FIG. 3) is used as the means to shift the sliding assembly in a side-to-side motion in order for the slide tubes 46 (FIG. 3) to slide side-to-side while supporting the weight of the brush lift assembly 48 (FIG. 3). Slide bushings 50 (FIG. 5) and slide seals 51 (FIG. 5) are used at each end of the two slide tubes 46 (FIG. 3). A brush lift assembly 48 (FIG. 3) comprises a rear yoke 52 (FIG. 3), two parallel lift plates 53 (FIG. 5) and a front yoke 54 (FIG. 5) attached to the forward end of the two parallel lift plates 53 (FIG. 5). The front yoke 54 (FIG. 5) has means to support a pivot pin 55 (FIG. 5) to allow the brush frame 56 (FIG. 5) to pivot left to right by the use of the hydraulic pivot cylinder 67 (FIG. 5). The brush frame 56 (FIG. 5) supports a brush 41 (FIG. 5) which is supported by the hydraulic brush motor 57 (FIG. 5) and idle shaft 68 (FIG. 5). The brush 41 (FIG. 5) uses components as seen in U.S. Pat. No. 4,926,517.

It should be clear at this point that a self propelled drivable road cleaning machine for clearing waste during road construction has been disclosed herein. However the present invention is not to be construed as limited to the forms shown which are to be considered illustrative rather than restrictive.

I claim:

1. A road construction surface cleaning machine comprising:

a motorized wheeled vehicle having a plurality of wheels and a vehicle frame having a cab for a driver of said vehicle attached to said frame, said motorized vehicle being drivable in a forward and reverse direction;

a sweeper brush frame supporting a sweeper brush mounted to one end of said vehicle, said sweeper brush frame having a hydraulic brush motor thereon for rotating said sweeper brush on said frame, said sweeper brush frame having a linkage to movably support said sweeper brush frame to said vehicle frame and having at least one hydraulic lift cylinder attached between said sweeper brush frame and said vehicle frame for raising and lowering said sweeper brush responsive to actuation of said hydraulic lift cylinder, said vehicle frame having a pair of slide tubes attached thereto having said sweeper brush frame linkage attached thereto and having a hydraulic side shift cylinder operatively connected between said vehicle frame and said sweeper brush frame linkage to shift said sweeper brush frame and sweeper brush on said parallel slide tubes in a side-to-side motion; and a scrapper blade assembly mounted to the other end of said vehicle, said scrapper blade assembly having a blade box holding a scrapper blade having a scraping blade edge, said scrapper blade assembly having a blade box hydraulic lift cylinder attached from said vehicle frame to a blade box drag link supporting said scrapper blade assembly for raising and lowering said scrapper blade assembly blade box and scrapper blade responsive to actuation of said lift cylinder, said blade box having a pair of lifting arm skid shoes mounted thereon extending forward and rearward of said blade box scraping edge, each said blade box drag link being attached to said scrapper blade assembly with a rubber boot allowing each said blade box skid shoe to rotate independently to move said blade box scraping blade edge to lift the blade box scraping edge over an obstacle;

whereby said road construction surface cleaning machine can scape and sweep a road surface.

2. The road construction surface cleaning machine in accordance with claim 1 in which said scrapper blade has a blade box pivot point directly above the scrapper blade edge to allow the blade assembly to change the angle of the blade and to lift the blade over obstacles.

3. The road construction surface cleaning machine in accordance with claim 1 in which said vehicle frame and cab are separate components allowing for quick assembly and removal of the cab from the vehicle frame.

4. The road construction surface cleaning machine in accordance with claim 3 which said vehicle cab is hingedly attached to said vehicle frame and has a cab tilt hydraulic cylinder thereby allowing the cab to be tilted up on said frame.

5. The road construction surface cleaning machine in accordance with claim 4 which said wheeled vehicle has a radiator and radiator clean out compartment positioned between the front and rear of the vehicle to allow better visibility out both the front and back of the surface cleaning machine.

6. The road construction surface cleaning machine in accordance with claim 1 in which each said wheel of said wheeled vehicle has an axle hub mount having mounting tabs that allow the wheel to be flipped.

7. A road construction surface cleaning machine comprising:

a motorized wheeled vehicle having a plurality of wheels and a vehicle frame having a cab for a driver of said vehicle attached to said frame, said vehicle frame and cab being separate components allowing for quick assembly and removal of said cab from the vehicle frame, each said wheel of said wheeled vehicle having an axle hub mount having mounting tabs that allow the wheel to be flipped;

a sweeper brush frame supporting a sweeper brush mounted to one end of said vehicle, said sweeper brush frame having a hydraulic brush motor thereon for rotating said sweeper brush on said frame, said sweeper brush frame having a linkage to movably support said sweeper brush frame to said vehicle frame and having at least one hydraulic lift cylinder attached between said sweeper brush frame and said vehicle frame for raising and lowering said sweeper brush responsive to actuation of said lift cylinder, said vehicle frame having a pair of slide tubes attached thereto having said sweeper brush frame linkage attached thereto and having a hydraulic side shift cylinder operatively connected between said vehicle frame and said sweeper brush frame linkage to shift said sweeper brush frame and sweeper brush on said parallel slide tubes in a side-to-side motion; and a scrapper blade assembly mounted to the other end of said vehicle, said scrapper blade assembly having a blade box holding a scrapper blade, said scrapper blade assembly having a linkage to movably support said scrapper blade assembly blade box and scrapper blade to said vehicle frame and having at least one hydraulic cylinder attached between said scrapper blade assembly blade box and said vehicle frame for raising and lowering said scrapper blade assembly blade box and scrapper blade responsive to actuation of said hydraulic cylinder; said scrapper blade assembly blade box having a pair of skid shoes mounted thereon extending forward and rearward of said scrapper blade scraping edge and said scrapper blade having a blade box pivot point directly above said scrapper blade scraping edge to allow said scrapper blade assembly to change the angle of the blade and to lift the blade over obstacles when said motorized wheeled vehicle is moving in a forward or reverse direction;

whereby said road construction surface cleaning machine can scape and sweep a road surface.

8. The road construction surface cleaning machine in accordance with claim 7 in which said vehicle cab is hingedly attached to said vehicle frame and has a cab tilt hydraulic cylinder thereby allowing the cab to be tilted up on said frame.

* * * * *